United States Patent [19]

Ohta

[11] 3,985,469

[45] Oct. 12, 1976

[54] OUTPUT CONTROL DEVICE FOR A HYDRAULIC PUMP OF THE VARIABLE DISPLACEMENT TYPE

[75] Inventor: Mitsuo Ohta, Tokyo, Japan

[73] Assignee: Tokyo Keiki Co., Ltd., Tokyo, Japan

[22] Filed: Sept. 4, 1974

[21] Appl. No.: 503,075

[30] Foreign Application Priority Data

Sept. 20, 1973 Japan ..... 48-105476

[52] U.S. Cl. ..... 417/222; 91/506

[51] Int. Cl.[2] ..... F04B 1/22

[58] Field of Search ..... 91/506, 378, 374, 382; 417/222

[56] References Cited

UNITED STATES PATENTS

| | | | |
|---|---|---|---|
| 2,413,301 | 12/1946 | Ellis | 412/222 |
| 2,732,808 | 1/1956 | Stoyke | 417/222 |
| 2,845,876 | 8/1958 | Real | 417/222 |
| 2,945,449 | 7/1960 | Feburo et al. | 91/506 |
| 3,017,750 | 1/1962 | Kempson | 91/378 |
| 3,302,585 | 2/1967 | Adams et al. | 417/222 |
| 3,669,570 | 6/1972 | Himmler | 91/506 |

FOREIGN PATENTS OR APPLICATIONS

| | | | |
|---|---|---|---|
| 3,927 | 8/1968 | Japan | 417/222 |
| 1,126,873 | 9/1968 | United Kingdom | 417/222 |
| 1,242,239 | 12/1968 | United Kingdom | 417/222 |

*Primary Examiner*—William L. Freeh
*Attorney, Agent, or Firm*—Toren, McGeady and Stanger

[57] ABSTRACT

In an output control device for a hydraulic pump of the variable displacement type wherein delivery pressure is led into a cylinder of the control device to move a control piston therein back and forth and let the piston change the inclination of a yoke, thereby varying the delivery of the pump, the improvement comprising a cam formed on a piston rod directly connected to the control piston, a hollow cylindrical sleeve slidable in the direction at right angles to the piston rod and adapted to remain in sliding contact with the cam so that, with the displacement of the control piston due to a rise of fluid pressure, the sleeve can be displaced by the cam away from the piston rod, said sleeve having a pressure pickup hole communicated with a fluid passage leading to the cylinder, a compensator piston slidably fitted in the sleeve and adapted to close the pressure pickup hole and shut off the flow of pressure fluid into the cylinder when the fluid pressure is zero and be moved, with the rise of fluid pressure, away from the pickup hole to open the same, and means for urging the compensator piston with a preset force into engagement with the piston rod, whereby the position of the pressure pickup hole is shifted according to the pump delivery so as to attain a desired pressure and control the pump output.

10 Claims, 7 Drawing Figures

FIG.5(III)
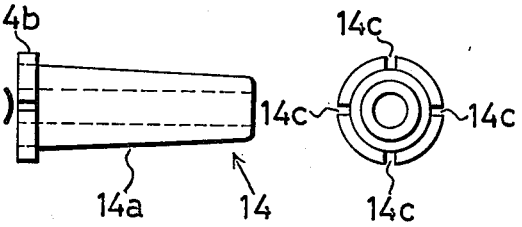

OUTPUT CONTROL DEVICE FOR A HYDRAULIC PUMP OF THE VARIABLE DISPLACEMENT TYPE

This invention relates to an output control device for a variable-displacement hydraulic pump in which delivery pressure is introduced into a cylinder to move a control piston and thereby change the inclination of a wobbler yoke for varied delivery.

Hydraulic pumps of the variable-displacement type for constant output or pressure control have already been proposed. However, no pump of this type that permits combined characteristic control or any particular characteristic output control has ever been introduced. The existing hydraulic pumps of the constant-pressure control type will require complete replacement of their controlling mechanisms if they are to be converted to the constant-output control type.

Under load conditions, for example when rotating a load or while being driven straightly, hydraulic equipment must often exhibit such output characteristics that it runs with constant torque (pressure) at low speed and with constant output at high speed. With a pump of the constant-pressure control type generally in use, the power requirement at high speed is remarkably large as indicated in FIG. 4. Because the driving power for the load at this time is small, the power loss is substantial and leads to a sharp increase of the fluid temperature. This shortens the life of hydraulic fluid and necessitates the use of a large-capacity cooler and a high-power electric motor, thus calling for excessive equipment cost and undue operating expenses.

It is a principal object of the present invention to provide an output control device for a variable-displacement hydraulic pump which overcomes the aforementioned disadvantages encountered in the prior art arrangements.

Another object of the invention is to provide a novel output control device for a variable-displacement hydraulic pump which can perform freely combined output control over constant-pressure and constant-output ranges according to the load characteristics or which can carry out the output control of desired characteristics.

In accordance with the present invention, an output control device is provided for a hydraulic pump of the type wherein delivery pressure is led into a cylinder of the control device to move a control piston therein reciprocatingly and thereby change the inclination of a yoke and vary the delivery of the pump, the device comprising a cam formed on a piston rod directly connected to the control piston, a hollow cylindrical sleeve slidable in the direction at right angles to the piston rod and adapted to remain in sliding contact with the cam so that, with the displacement of the control piston due to a rise of fluid pressure, the sleeve can be displaced by the cam away from the piston rod, said sleeve having a pressure pickup hole communicated with a fluid passage leading to the cylinder, a compensator piston slidably fitted in the sleeve and adapted to close the pressure pickup hole and shut off the flow of pressure fluid into the cylinder when the fluid pressure is zero and be moved, with the rise of fluid pressure, away from the pickup hole to open the same, and means for urging the compensator piston with a preset force toward the piston rod, whereby the position of the pressure pickup hole is shifted according to the pump delivery so as to attain a desired pressure and control the output.

Still another object of the invention is to provide an output control valve of the character described which can have any desired delivery-pressure characteristic by choosing a suitable shape for the cam.

Yet another object of the invention is to provide an output control valve of the character described which has means for smoothening the motion of the sleeve and that of the compensator piston slidably fitted in the sleeve, so that those motions can follow closely changes of delivery.

A further object of the invention is to provide a variable-displacement hydraulic pump which has means for making adjustable the stable pressure whereby the force acting on the pressure-receiving surface of the compensator piston is balanced with the pressure force exerted by the means for displacing the piston into engagement with the piston rod, so that, by the cooperation of the said means with the sleeve, the pump operates stably with a desirable delivery and pressure corresponding to the opening of the discharge passage.

One feature of the invention is that, when a veriable-displacement hydraulic pump of the character described is to be converted, for example, from the constant-pressure type to the constant-output type, there is no need of completely replacing the control device as in conventional arrangements but it is only necessary to exchange the cam in order to perform easily the combined control for constant pressure and output and also carry out the output control with any desired delivery-pressure characteristic.

The aforesaid feature of the invention presents a further advantage that the installation and operating cost of the hydraulic equipment fitted with a hydraulic pump incorporating the invention is substantially reduced as compared with ordinary installations.

These and other objects, features and advantages of the present invention will become apparent from the following description taken in connection with the accompanying drawings showing preferred embodiments thereof. In the drawings.

Figure 1:
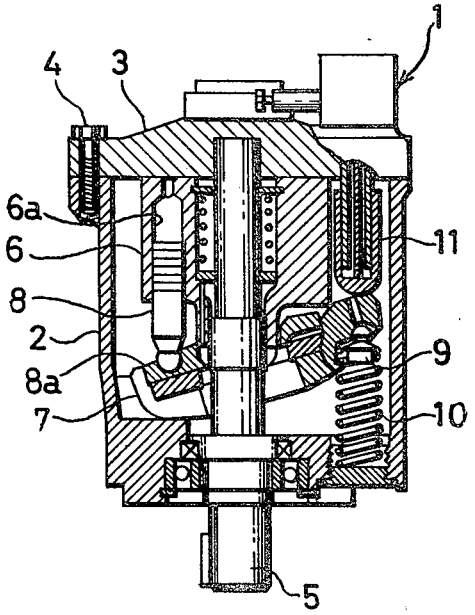
FIG. 1 is a vertical sectional view of a variable-displacement hydraulic pump equipped with an output control device embodying the invention.

Referring to FIG. 1, which is a vertical section through a variable-displacement hydraulic pump or axial piston pump equipped with an output control device 1 of the invention, there are shown a housing 2 and a head 3 secured to it by bolts 4 to close the open top of the housing. An input shaft 5 is journaled in the pump, rotatably with respect to the housing 2 and the head 3. A cylinder block 6, forming a plurality of cylinders 6*a* therein, is slidably engaged at one end with the head 3 and is made fast in the center on the input shaft 5 that extends through the center of the pump. Near the lower end of the cylinder block 6, a yoke 7 is supported by the housing 2 in such a manner as to wobble but remain unrotated. In each cylinder 6*a* is slidably fitted a piston 8, which is spherical at one end for pivotal connection to a slidable and turnable shoe 8*a* on the yoke 7. A control piston 11, engaged at the lower end with the yoke 7, is movable reciprocatingly, or up and down as shown, to vary the inclination of the yoke. A member 9 normally forces the yoke against the piston 11 by virtue of a compression spring 10 disposed between the member 9 and the housing 2. The construction described above is typical of the axial piston pumps of known types. Therefore, further details, such as the mechanisms for turning the shoes 8*a* and wobbling the yoke 7, are omitted from the figure.

The output control device 1 of the invention will now be described with reference specifically to FIG. 2. It comprises a body 12 fastened to the head 3 by suitable means and formed with a hollow, cylindrical projection 12*a*, cylinder holes 12*b*, 12*c* crossing at right angles to each other, a passage 12*d* for supplying pressure fluid to the holes 12*b*, 12*c*, a fluid passage 12*e* connecting the hole 12*c* with a hollow cylinder 13 fixedly extended through the head 3, and drain holes 12*f*, 12*f'*. The control piston 11 already referred to is slidably fitted on the cylinder 13, and its semispherical lower end is at all times engaged with the yoke 7. A piston rod 11*a*, formed in one piece with the piston 11, extends upward through the cylinder 13 into the hole 12*b*. Inside the same hole there is a cam 14, consisting of a cam part 14*a*, for example of a conical shape, and a straight part 14*b* slidable in the cylinder hole 12*b*. The cam 14 is fixed to the upper end of the piston rod 11*a* by a nut 15. A sleeve 16 has a pressure pickup hole 16*a* in communication with the fluid passage 12*e* and a drain hole 16*b* communicated with the fluid passage 12*f*. The sleeve 16 fits slidably in the cylinder hole 12*c* and is kept in engagement with the cam part 14*a* by a spring 17 installed between the other end of the sleeve and the end of the cylinder hole 12*c*. A compression spring 19 is disposed between an adjust screw 18 in thread engagement with the front end of the cylindrical projection 12*a* and a washer 20 in the projection. In the sleeve 16 and the body 12 is slidably disposed a compensator piston 21, which has a land 21*a* for opening and closing the pressure pickup hole 16*a* of the sleeve 16 and a land 21*b* for shutting off the communication between the drain hole 16*b* and the spring-loaded portion of the cylinder hole 12*a*. One end of the compensator piston 21 is engaged with the washer 20, which in turn is urged by the spring 19 so that the other end of the piston 21 is biased in the direction for engagement with the piston rod 11*a* and, when there is no hydraulic pressure applied, the piston 21 engages the piston rod 11*a* and its land 21*a* assumes the position where it closes the pressure pickup hole 16*a*.

Figure 2:
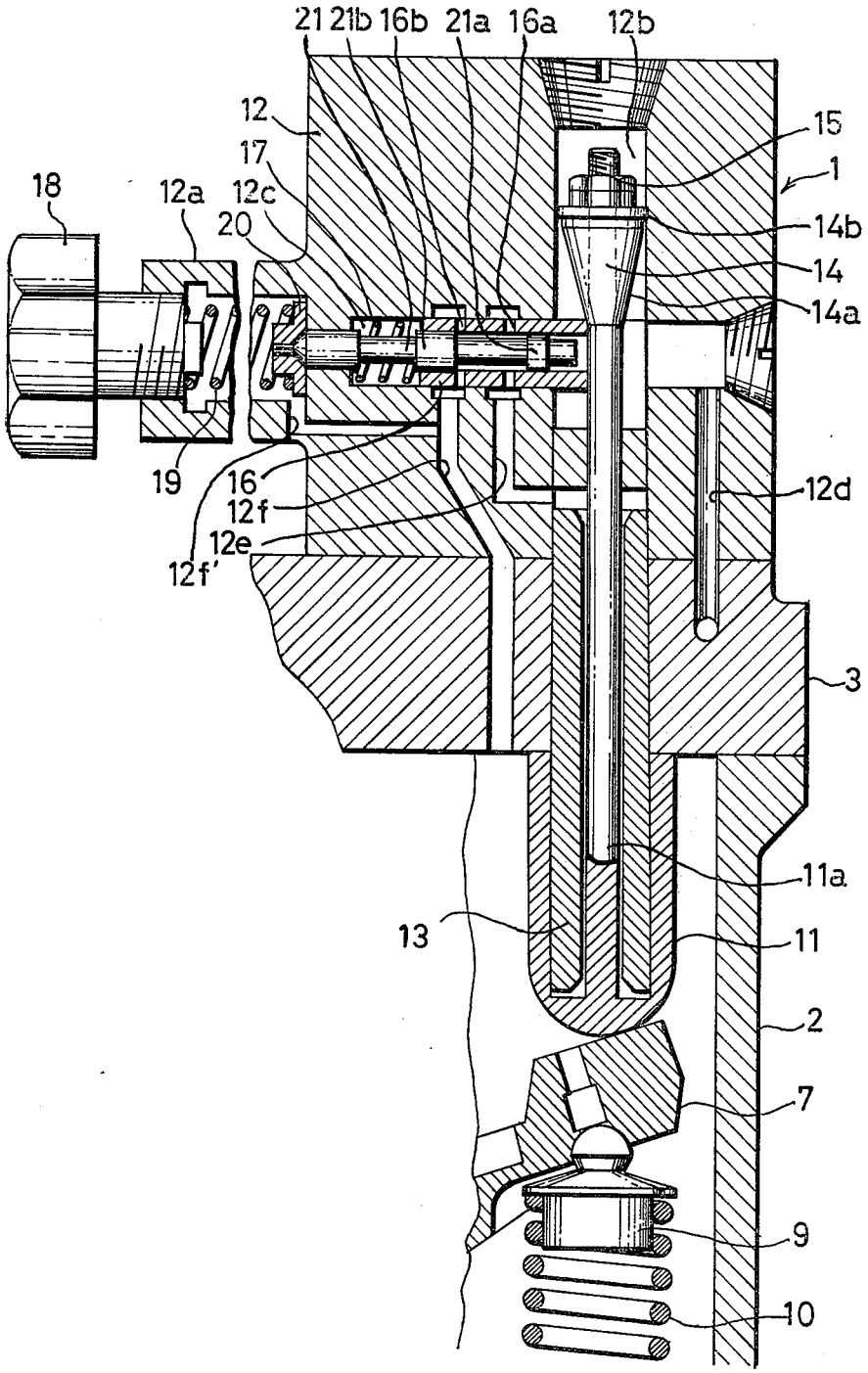
FIG. 2 is an enlarged fragmentary view, in vertical section, of the device shown in FIG. 1.

With the construction described, the pump incorporating the embodiment of the invention is in the position shown in FIG. 2 when it starts, with the yoke 7 tilted to a maximum degree for maximum delivery.

Now if a discharge fluid passage not shown remains closed, the hydraulic pressure will begin a rapid increase, acting on the compensator piston 21, via the fluid passage 12*d* and the cylinder hole 12*b*, to move the piston to the left. Although the compensator piston 21 is normally urged rightward by the spring 19, it begins to move to the left as the incoming fluid pressure overwhelms the preset pressing force of the spring 19. When the land 21*a* of the piston 21 opens the pressure pickup hole 16*a* into communication with the cylinder 12*b*, the fluid reaches the cylinder 13 through the passage 12*e*, pushing down the control piston 11 and thereby reducing the inclination of the yoke 7 for a corresponding decrease in delivery. Lowering the piston 11 and therefore the cam 14 secured to the piston rod 11*a*, moves the sleeve 16 engaged with the cam part 14*a*, to the left, in sliding contact with the cam part. This moves the pressure pickup hole 16*a*, too, to the point where it is reclosed by the land 21*a*. Consequently, the pressure rises again, pushing the piston 21 farther to the left and causing the land 21*a* to move past the hole 16*a* and thereby re-establish the communication between the hole 16*a* and the fluid passage 12*e* to push the control piston 11 further downward. The same step is repeated until the inclination of the yoke 7 is reduced to naught and the delivery is theoretically decreased to zero. (Strictly speaking, the delivery will not be zero because there is maintained some fluid flow due to leaks from the pump components.) At this point, the sleeve 16 is in contact with the maximum diameter portion of the conical cam part 14*a* of the cam 14, and its pressure pickup hole 16*a* is in the left-end position. The land 21*a* of the compensator piston 21 is in the stable position where it closes the pressure pickup hole 16*a*. The stable pressure at this time is such that the force acting on the right-hand end of the compensator piston 21 is balanced with the preset pressing force of the spring 19. This means that the stable pressure is at a maximum when the delivery is zero and the value is governed by the pressure setting of the spring 19. Thus, the stable pressure can be varied by turning the adjust screw 18 forward or backward.

Next, when the discharge passage of the pump is opened, the pressure drops. In the same manner as already described, the pressure is conducted to the control piston 11 but, because of the pressure drop, the force with which the piston 11 is pushed down decreases. As a consequence, the spring 10 pushes back the yoke 7, increasing its inclination and therefore the pump delivery. Because the control piston 11 and with it the cam 14 move upward, the sleeve 16 is moved to the right under the urging of the spring 17 in sliding contact with the cam part 14*a*, from its maximum diameter portion to the smaller diameter portion. This shifts the stable position of the compensator piston 21 to the right and allows the spring 19 to expand fully, reducing its pressing force and therefore the stable pressure.

Figure 5I:
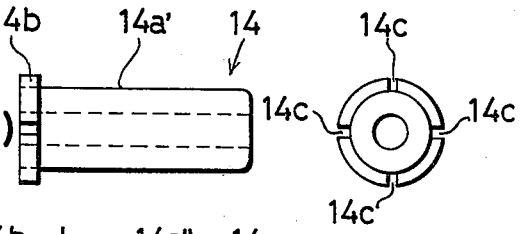
FIGS. 5(I), (II) and (III) are combinations of front and side views of three different cams according to the invention.
Figure 5:
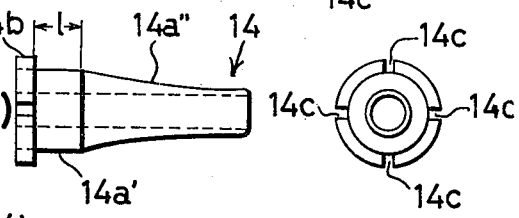

FIGS. 5(I), (II) and (III) illustrate modified forms of the cam 14. The cam shown in FIG. 5(I) is intended for use in constant-pressure control. Here the cam part 14*a'* may take a straight cylindrical form because there is no need of changing the position of the pressure pickup hole 16*a* of the sleeve 16. A cam 14 for the combined control purpose of constant pressure and output control is represented in FIG. 5(II). The cam consists of a straight cylindrical part 14*a'* having a length $l$ for constant-pressure control and a part 14*a''* hyperbolic in section for constant-output control. It will serve as a constant-output control cam when $l = 0$. Inasmuch as the output depends upon the length $l$ of the cylindrical part 14*a'* (i.e., upon the flow rate), it is possible to choose the constant-pressure and constant-output ranges freely by setting the length $l$ to a desirable value. Such is what the term "combined control" as used herein means.

The cam 14 for given characteristic control may use a part of a cone as shown in FIG. 5(III). The sectional contour of the cone has only to match the characteristics desired.

Throughout FIGS. 5, the reference numeral 14*c* indicates a plurality of slits formed in the flange portion 14*b* of each cam 14 that fits in the cylinder hole 12*b*.

Referring back to FIG. 2, the sleeve 16 is shown movable to the right or left by the amount of deflection of the spring 19 corresponding to the maximum pressure the hydraulic pump develops. The left-end position to which the sleeve 16 can move corresponds to the maximum diamemter of the cam 14, and the right-end position is distant to the right by the amount of deflection of the spring 19. In practice, however, the sleeve 16 is seldom moved to the right extremity because in few cases the hydraulic pressure is reduced to zero.

The pressure pickup hole 16*a* and the drain hole 16*b* formed in the sleeve must be kept in communication with the fluid passages 12*e* and 12*f*, respectively. For this purpose those holes 16*a*, 16*b* should be surrounded by the annular fluid channels shown. The widths of the channels are equal to the sums, respectively, of the diameters of the holes 16*a*, 16*b* and the amount of deflection of the spring 19. Because of a difference between the fluid pressures therein, these fluid channels must be spaced a sufficient distance from each other to minimize the fluid leakage. Considering this, the distance between the holes 16*a* and 16*b* may be so chosen as to equal the sum of the channel widths and the distance between the channels.

The compensator piston 21 shown in FIG. 2 may dispense with the land 21*b* because the spool of the piston 21 is long enough to serve as an anti-rotational reinforcement. It is also possible to provide the lands 21*a* and 21*b* a sufficient distance apart for keeping the pressure pickup hole 16*a* and the drain hole 16*b* in communication even after the land 21*a* has moved past the hole 16*a* to the right extremity of its travel. The same applies to the compensator piston 21 in another embodiment of the invention to be described later with reference to FIG. 3. It is noted, however, that the land 21*b* serves to prevent fluid leak to the drain hole because the cylinder hole 12*c* is being subjected to the fluid pressure.

The drain hole 16*b* provides a passage through which the fluid from the cylinder 13 can escape. Thus, the fluid flows from the cylinder 13, via the fluid passage 12*e*, fluid channel, pressure pickup hole 16*a*, the recess of the compensator piston 21, drain hole 16*b*, fluid channel, and the fluid passage 12*f*, in the order mentioned, into the pump body.

Figure 3:
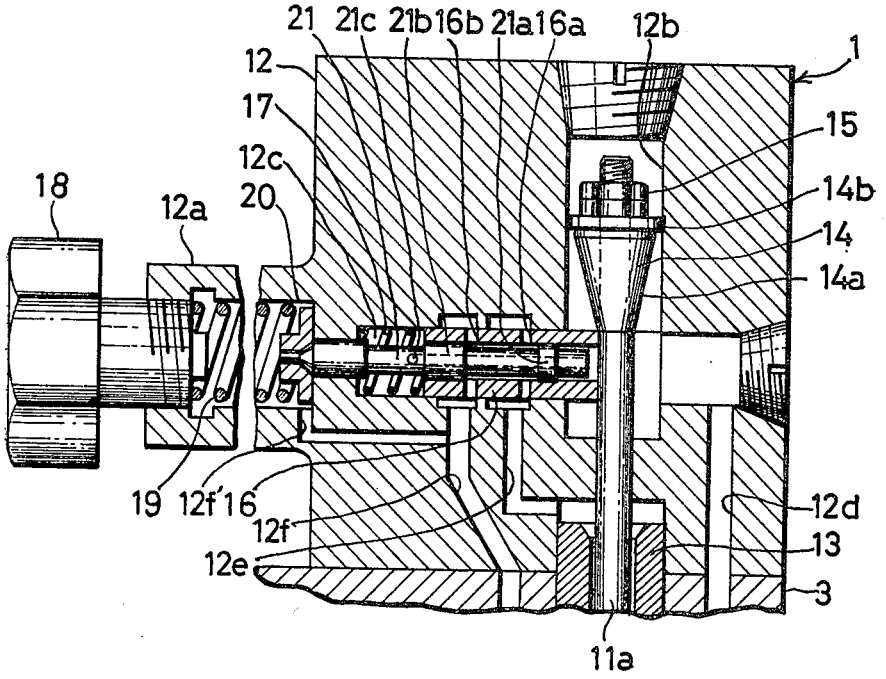
FIG. 3 is a view similar to FIG. 2 but showing another embodiment of the invention.

In the other embodiment of the invention shown in FIG. 3, the compensator piston 21 has a fluid passage 21*c* for conducting pressure fluid from the space between the piston rod 11*a* and the right-hand end of the compensator piston 21 to the portion of the cylinder 12*c* loaded with the spring 17. This passage 21*c* functions to balance the fluid pressure applied on the end of the compensator piston with that on the left-hand end of the land 21*b*. Consequently, the motion of the piston 21 follows closely changes of the delivery pressure. This eliminates the need of using a very strong spring 17 and facilitates the manufacture of the device.

As noted above, in the device of the invention, stability is attained by the pressure and the amount of fluid discharged according to the opening of the discharge passage. It is therefore possible to achieve the output control with desired delivery-pressure characteristics for constant pressure, constant horsepower, or the both by choosing suitable configurations for the cam part 14*a* of the cam 14.

Figure 4:
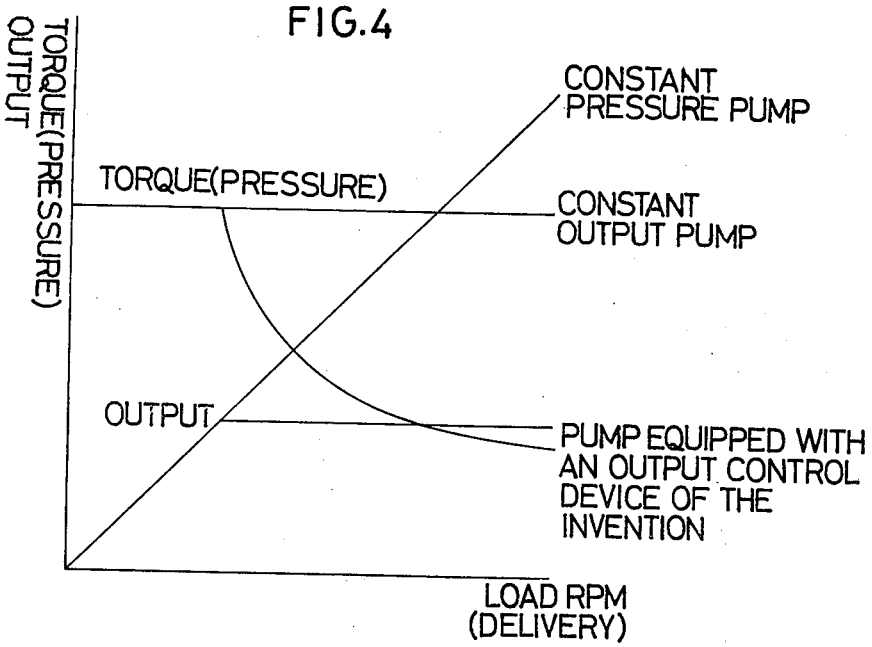
FIG. 4 is a torque-rpm characteristic curve of the device of the invention.

Thus, the shape of the torque-rpm curve, or the output characteristic, given in FIG. 4 can be freely and easily changed by simply exchanging the cam 14 with one having configurations suited for the particular characteristic desired.

As has been described, the present invention eliminates the disadvantages of the conventional devices, reduces the installation cost to about half that of an ordinary device having the same capacity, permits the use of a pump-driving motor with a considerably reduced capacity, and renders it possible to save the operation cost substantially.

What is claimed is:

1. In an output control device for a hydraulic pump of the variable displacement type including a cylinder having a control piston and a piston rod reciprocally movable therein, a yoke arranged to vary the delivery of said pump by change in the inclination of said yoke in response to movement of said piston, and means for feeding a delivery pressure of said pump into said cylinder to move said piston thereby to effect variation in the inclination of said yoke, the improvement comprising a cam formed on the piston rod of said control piston, a hollow cylindrical sleeve mounted for slidable movement in directions perpendicular to said piston rod and arranged to remain in sliding contact with said cam to be displaced by said cam away from said piston rod with displacement of said control piston due to a rise in fluid pressure, a fluid passage leading to said cylinder, a pressure pickup hole defined in said sleeve in flow communication with said fluid passage, a compensation piston slidably fitted in said sleeve and adapted to close said pressure pickup hole to shut off flow of pressure fluid into said cylinder when the fluid pressure is zero and to be moved upon a rise of fluid pressure away from said pickup hole to open said pickup hole, a compensation piston fluid passage extending from one end of said compensation piston facing said piston rod to the cylinder hole in order to effect balancing of the forces applied to both ends of said sleeve by the fluid pressure exerted in said compensation piston fluid passage, and means for urging said compensation piston with a preset force into engagement with said piston rod, the position of said pressure pickup hole being shifted according to the delivery of said pump in order to attain a desired pressure and to control the pump output.

2. A device according to claim 1, wherein said cam comprises a partially conical shape to effect a given characteristic control.

3. A device as claimed in claim 1, wherein said sleeve is urged in contact with the cam by a spring fitted between the end of the sleeve and the cylinder hole.

4. A device as claimed in claim 1, wherein said means for urging the compensator piston into engagement with the piston rod consists of a spring and an adjust screw supporting the spring, said screw being turnable to adjust the pressing force of the spring against the piston and thereby cooperate with the sleeve to set a stable pressure as desired.

5. A device as claimed in claim 4, wherein said compensator piston has a land capable of opening and closing the pressure pickup hole of the sleeve and a land for releasing fluid from the cylinder through a drain hole formed in the sleeve.

6. A device as claimed in claim 5, wherein said pressure pickup hole and drain hole of the sleeve are spaced a distance equal to the sum of the widths of two annular fluid channels formed around the sleeve and the distance between the two channels, the width of each channel equalling the sum of the amount of deflection of the spring for pressing the sleeve and the diameter of either hole facing the particular channel.

7. A device according to claim 1, wherein the shape of said cam operates to effect a particular characteristic control, said device being arranged to enable interchangeability of said cam so that cams of different shapes may be interchangeably selectively mounted upon said piston rod to provide for a particular characteristic control of said device.

8. A device according to claim 7, wherein said cam is cylindrically shaped to effect constant-pressure control.

9. A device according to claim 7, wherein said cam comprises a hyperbolic cross sectional configuration to effect constant-output control.

10. A device according to claim 7, wherein said cam comprises a combined cylindrical shape and a hyperbolic cross sectional shape in order to effect both constant-pressure control and constant-output control.

* * * * *